US005758668A

United States Patent [19]

Beaver

[11] Patent Number: 5,758,668

[45] Date of Patent: Jun. 2, 1998

[54] PIPE TOOL AND FILLING METHOD

[76] Inventor: George M. Beaver, 4190 Ridgewood Ave., Port Orange, Fla. 32127

[21] Appl. No.: 755,681

[22] Filed: Nov. 25, 1996

[51] Int. Cl.[6] ..... A24F 9/10

[52] U.S. Cl. ..... 131/246; 131/247; 131/329

[58] Field of Search ..... 131/247, 243–246, 131/177, 329

[56] References Cited

U.S. PATENT DOCUMENTS

| | | | |
|---|---|---|---|
| 45,258 | 11/1864 | Matile | 131/247 |
| 734,295 | 7/1903 | Blanpled | 131/247 |
| 865,547 | 9/1907 | Walker | 131/243 |
| 1,519,261 | 12/1924 | Ranney | 131/243 |
| 1,519,955 | 12/1924 | Ciulla et al. | 131/247 |
| 2,294,133 | 8/1942 | Cleaner | 131/247 |
| 2,725,764 | 12/1955 | Seez | 131/247 |
| 4,444,211 | 4/1984 | MacDonald | 131/246 |
| 4,516,586 | 5/1985 | Koito et al. | 131/246 |

*Primary Examiner*—Vincent Millin
*Assistant Examiner*—Charles W. Anderson
*Attorney, Agent, or Firm*—Paul S. Rooy

[57] ABSTRACT

A pipe tool and method of filling. The pipe tool comprises a handle rigidly attached to a spade at an angle of approximately 225 degrees. A cross-sectional shape of an upper extreme of the spade is that of an arc of approximately 70 degrees, and a lower extreme whose shape is that of a spherical section. A cross-sectional thickness of said spade decreases linearly from the spade upper extreme to the spade lower extreme. The handle has a tamper which is shaped like a half-circle. The method of filling comprises the steps of inserting the pipe tool into a bowl tobacco bore so that the spade nests against and covers a bowl smoke bore mouth; filling the bowl tobacco bore to overflowing with tobacco; tamping the tobacco in a front of the bowl tobacco bore only downwards at an angle of at least 45 degrees to a bowl tobacco bore vertical axis; repeating the first two steps until a level of tobacco over the bowl smoke bore mouth is ¼–½ inches above the bowl smoke bore mouth; removing the pipe tool from the bowl tobacco bore; filling the bowl tobacco bore to overflowing with the tobacco; tamping the tobacco in the front of the bowl tobacco bore only downwards at an angle of at least 45 degrees to a bowl tobacco bore vertical axis; and repeating the previous two steps until a level of tobacco over the bowl smoke bore mouth is slightly below a top edge of the bowl tobacco bore.

4 Claims, 4 Drawing Sheets

FIG 7
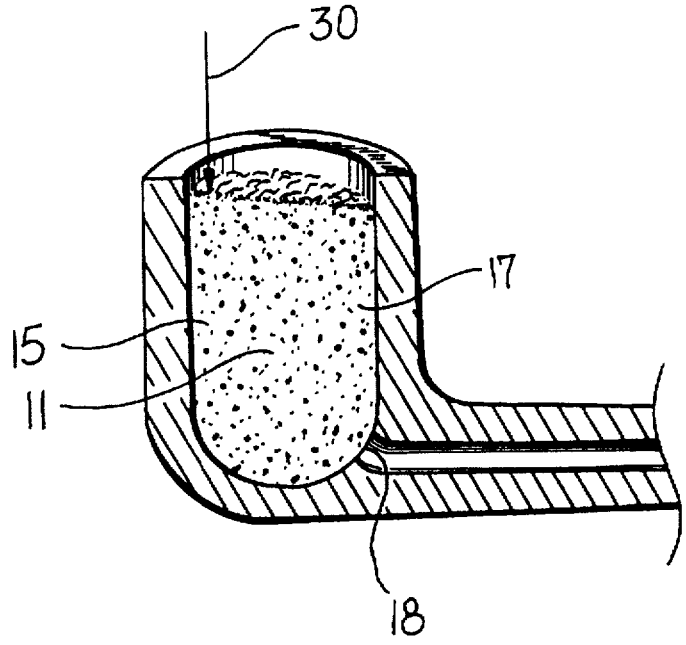
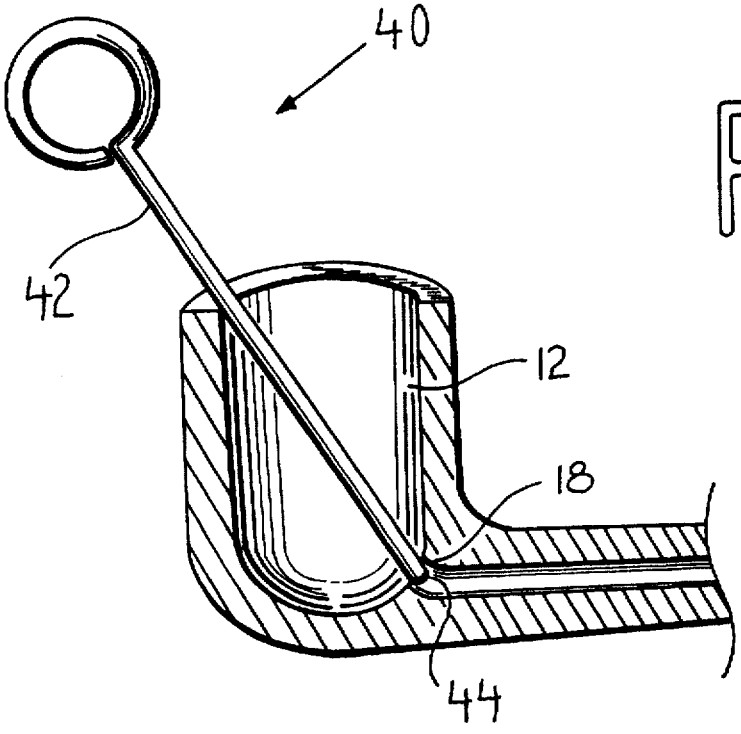
FIG 8

PIPE TOOL AND FILLING METHOD

BACKGROUND OF THE INVENTION

1. Field of the Invention

This invention relates to smoking pipe tools, and in particular to a pipe tool and method of filling same with tobacco.

2. Background of the Invention

The pastime of pipe smoking has been in existence for centuries. It is believed that pipes had been used in Europe for smoking medicinal herbs many years before tobacco smoking was introduced there. Tobacco smoking began with the American Indians, who introduced tobacco pipes to white settlers. The Indians smoked tobacco in a ceremonial peace pipe, or calumet. In 1586 Sir Ralph Lane, the commander of a colony in Virginia, introduced tobacco pipe smoking to Europe by sending a tobacco pipe to Sir Walter Raleigh. Legend relates that when Sir Walter Raleigh's servant saw him smoking for the first time, he threw a bucket of water on Sir Raleigh, because he thought his master was on fire!

Over the years, tobacco pipe smoking has enjoyed consistent popularity. During recent decades, tobacco pipe smoking has experienced a resurgence in popularity, in part due to the increased public awareness of the health hazards of cigarette smoking.

Existing Designs

Conventional tobacco pipes incorporate a bowl attached to a stem. Typically the stem is removable from the bowl for cleaning. The bowl is generally made from brier root, which grows near the Mediterranean coast. These roots frequently have a beautiful grain, and are extremely hard and heat resistant. Other pipe bowls are made of corncob, clay, porcelain, or meerschaum (a clay-like material). Most pipe stems are made of hard rubber, plastic, or wood. Generally the stem is frictionally engaged with the bowl, so that the stem may be removed from the bowl using a twisting, pulling motion.

The pipe bowl features a bowl tobacco bore which is filled with tobacco for smoking, which communicates with a bowl smoke bore through a bowl smoke bore mouth at the intersection of the bowl tobacco bore and the bowl smoke bore. The stem incorporates a stem bore in communication with the bowl smoke bore at one extreme and a mouthpiece at another extreme. In this manner, smoke produced by virtue of tobacco combustion occurring in the bowl tobacco bore travels through the bowl smoke bore mouth to the bowl smoke bore, and thence through the stem bore to the mouthpiece, where it is available for use by the smoker.

There are a number of problems associated with current tobacco pipe designs. One problem is the small size of typical bowl smoke bore mouths. As may be observed in FIG. 1, conventional pipes incorporate bowl tobacco bore 12 which communicates with stem bore 16 through bowl smoke bore mouth 18 and bowl smoke bore 14. The size of bowl smoke bore mouth 18 is typically very small compared to the surface area of tobacco burning within bowl tobacco bore 12. Consequently, bowl smoke bore mouth 18 generally becomes a bottleneck to smoke, combustion byproducts, and tobacco fragments. This bottleneck leads to a number of problems. One problem is that bowl smoke bore mouth 18 tends to clog with tobacco fragments, liquefied nicotine and tars, and other combustion byproducts. This causes the pipe draw to become difficult, thus negatively impacting the smoker's enjoyment. In addition, if the clogging becomes extreme, the pipe may actually go out, necessitating that the smoker re-light the pipe. Another problem associated with the current small bowl smoke bore mouths is that as the tobacco in the pipe bowl bore burns down, the restricted draft available through the bowl smoke bore requires the smoker to tamp down the tobacco within the pipe bowl numerous times during each pipe smoked. This laborious tamping requirement is time-consuming and inconvenient. Sometimes the clogging of the bowl smoke bore mouth is sufficiently severe to compel the smoker to poke a reamer down through the tobacco in the pipe bowl to the bowl smoke bore mouth, in order to clear a passageway so that tobacco combustion can continue within the pipe bowl.

Finally, the bowl smoke bore mouth bottleneck is easily clogged, and thus requires frequent cleanings on the part of the smoker. The tobacco pipe cleaning process is laborious and time consuming. First the pipe must be emptied. Then the bowl must be disassembled from the stem. Then the bowl tobacco bore is cleaned. The next step is to clean out the bowl smoke bore, generally by reaming it out with a pipe cleaner. Special attention must be given to ensure the critical bowl smoke bore mouth is thoroughly cleaned. Then the stem bore must be cleaned, generally by reaming it out with a pipe cleaner. Finally, the bowl must be re-assembled to the stem. Thus, the current bowl smoke bore mouth bottleneck designs demand frequent pipe cleanings.

Another set of problems associated with current tobacco pipe use is the bowl smoke bore mouth clogging that can occur when a pipe is emptied. If the pipe is emptied from front to back, using a pipe tool, the action of scooping out the combustion residue can actually further clog the bowl smoke bore mouth. This clogging can render the pipe difficult to use, or even necessitate a complete pipe cleaning.

SUMMARY OF THE INVENTION

Accordingly, it is an object of the present invention to provide a pipe tool and filling method which prevents bowl smoke bore mouth clogging. Design features allowing this object to be accomplished include a pipe tool sized to fit into a standard smoking pipe. Advantages associated with the accomplishment of this object include a smooth, consistent draw, along with increased smoking pleasure.

It is another object of this invention to provide a pipe tool and filling method which provides a consistently packed tobacco fill, thereby avoiding tobacco which is packed too tightly or too loosely. Design features enabling the accomplishment of this object include a pipe tool and method of filling including the steps of inserting the pipe tool into a pipe bowl tobacco bore, filling the bowl tobacco bore with tobacco, and removing the pipe tool from the bowl tobacco bore. Advantages associated with the realization of this object include reduced tobacco tamping and reaming, elimination of hard draw, and reduction of the need for re-lighting the pipe.

It is still another object of the present invention to provide a pipe tool and filling method which reduces bowl smoke bore mouth clogging when the pipe is emptied. Method features allowing this object to be accomplished include the step of using a pipe tool to evacuate combustion residue in a direction away from the bowl smoke bore mouth only. Benefits associated with the accomplishment of this object include reduced necessity to clean the pipe, and a more consistent draw, along with the associated enhanced smoking pleasure.

It is yet another object of this invention to provide a pipe tool and filling method which is inexpensive. Design features allowing this object to be achieved include the use of components made of readily available materials. Benefits associated with reaching this objective include reduced cost, and hence increased availability to the consumer.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3 and 4. Sheet three contains FIGS. 5 and 6. Sheet four contains FIGS. 7 and 8.

FIG. 7 is a side cross-sectional view of a pipe with its bowl tobacco bore full of tobacco, ready for smoking.

FIG. 8 is a side cross-sectional view of an alternate embodiment tool being used to fill a bowl tobacco bore in accordance with the method of filling disclosed herein.

DETAILED DESCRIPTION OF THE PREFERRED EMBODIMENT

Figure 2:
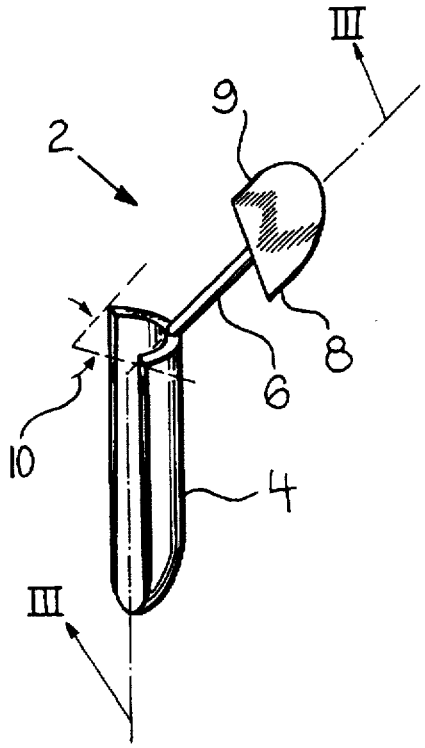
FIG. 2 is a side view of a pipe tool.
Figure 3:
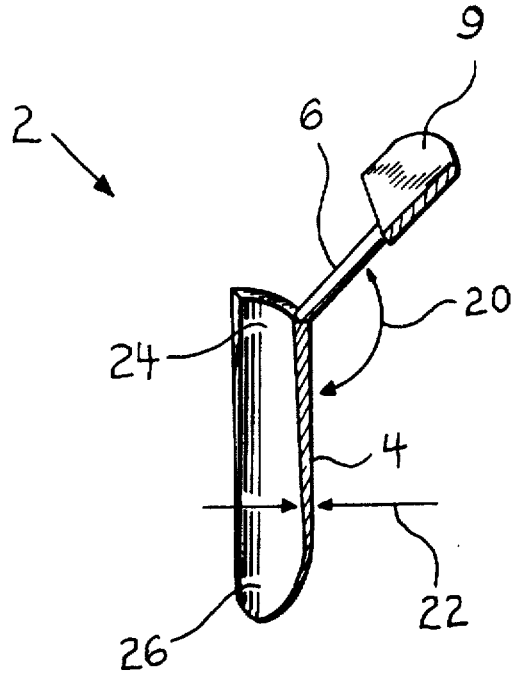
FIG. 3 is a side cross-sectional view of a pipe tool taken at section III—III of FIG. 2.

FIG. 2 is a side view of pipe tool 2. Pipe tool 2 comprises spade 4 rigidly attached to handle 8 at a handle angle 20 of approximately 225 degrees. Handle 8 comprises tamper 9 rigidly attached to stem 6. A plan view shape of tamper 9 is a half circle. Referring now also to FIG. 3, a side cross-sectional view of pipe tool 2 taken at section III—III of FIG. 2, spade 4 comprises spade upper extreme 24 and spade lower extreme 26. A cross-sectional shape of spade upper extreme 24 is an arc, and in the preferred embodiment spade upper extreme 24 spanned a spade arc angle 10 of approximately 70 degrees. Spade lower extreme 26 is a spherical section sized to fit into the lower part of bowl tobacco bore 12.

As may be observed in FIG. 3, spade thickness 22 decreases from spade upper extreme 24 to spade lower extreme 26, to facilitate removing pipe tool 2 from bowl tobacco bore 12 after filling.

Figure 1:
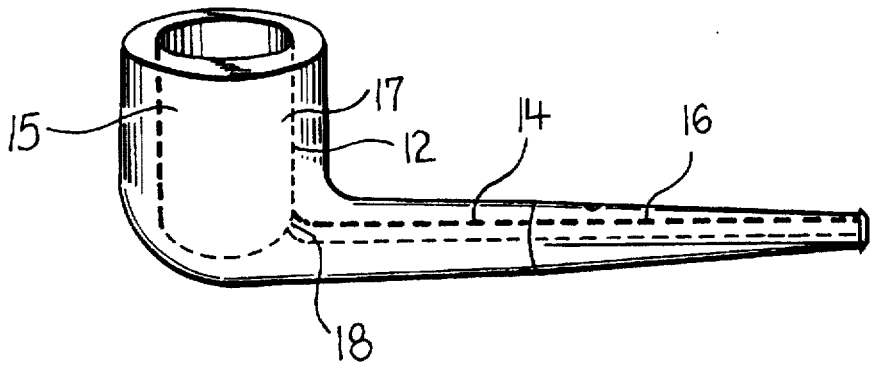
FIG 1 PRIOR ART
FIG. 1 is a side isometric view of an existing tobacco pipe design.
Figure 4:
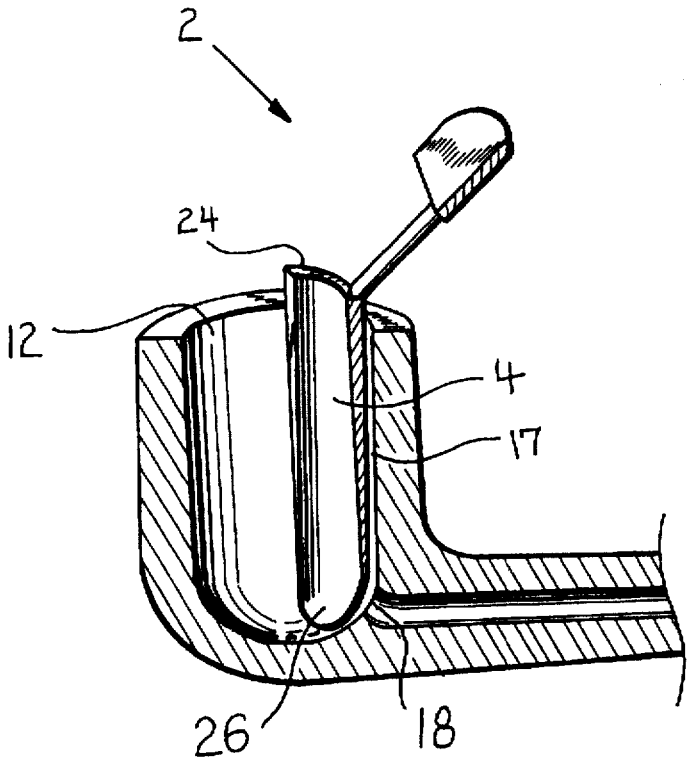
FIG. 4 is a side cross-sectional view of a pipe tool inserted into a bowl tobacco bore, ready for filling.

As may be observed in FIG. 1, bowl tobacco bore 12 comprises a bowl tobacco bore rear section 17 surrounding bowl smoke bore mouth 18, and a bowl tobacco bore front section 15 diametrically opposed to bowl tobacco bore rear section 17. FIG. 4 is a side cross-sectional view of pipe tool 2 inserted into bowl tobacco bore rear section 17, ready for filling. Spade upper extreme 24 is arcuately shaped, and nests into the curvature of bowl tobacco bore 12. Spade lower extreme 26 is a spherical section which nests into a section of bowl tobacco bore 12 around bowl smoke bore mouth 18, thus preventing tobacco from entering and clogging bowl smoke bore mouth 18.

Figure 5:
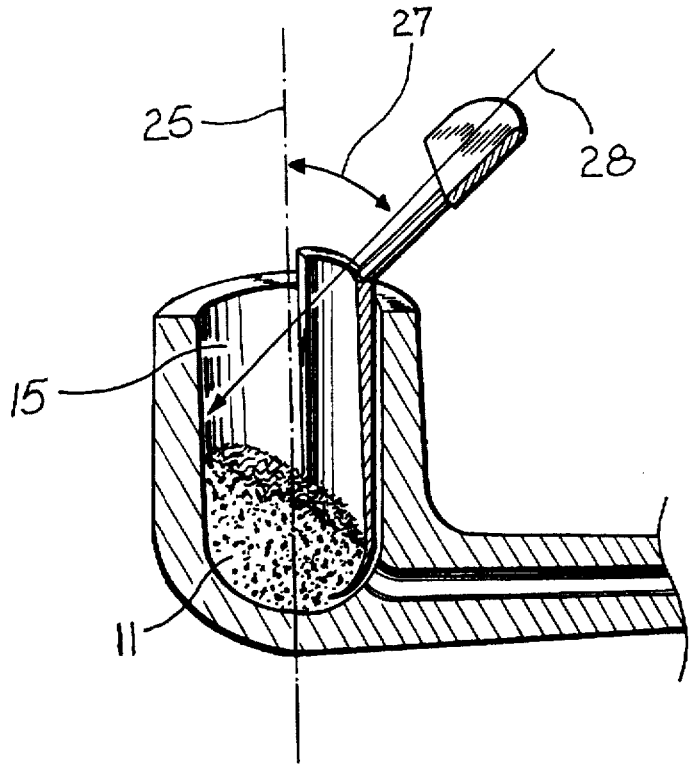
FIG. 5 is a side cross-sectional view of a pipe tool inserted into a bowl tobacco bore, illustrating the steps of filling with tobacco and tamping forwards.

FIG. 5 is a side cross-sectional view of pipe tool 2 inserted into bowl tobacco bore 12, illustrating the steps of filling bowl tobacco bore 12 with tobacco 11, and tamping it forwards. Bowl tobacco bore 12 comprises bowl tobacco bore vertical axis 25. Tobacco 11 is loosely inserted into bowl tobacco bore 12 until overflowing. Tobacco 11 is then tamped forwards using at least one finger or other appropriate tamping tool, at a tamping angle 27 of at least 45 degrees, in the direction indicated by tamping direction arrow 28. Tamping angle 27 is the angle between bowl tobacco bore vertical axis 25 and tamping direction arrow 28. It was experimentally determined that a tamping angle 27 of at least 45 degrees is the optimum tamping angle 27 to use to achieve the objects of the instant invention. Note that a handle angle 20 of approximately 225 degrees accommodates a tamping angle 27 of 45 degrees, which is the reason that in the preferred embodiment, handle angle 20 is approximately 225 degrees. The steps of filling to overflowing, and forward tamping, are repeated as required (approximately three times) until bowl tobacco bore 12 is filled to the extent illustrated in FIG. 6.

Figure 6:
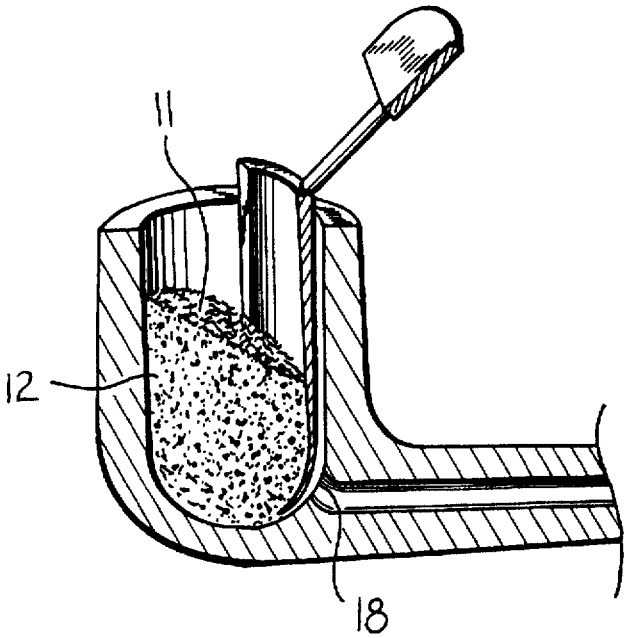
FIG. 6 is a side cross-sectional view of a pipe tool inserted into a bowl tobacco bore, with the bowl tobacco bore filled sufficiently to proceed to the next filling step of removing the pipe tool from the bowl tobacco bore.

FIG. 6 is a side cross-sectional view of pipe tool 2 inserted into bowl tobacco bore 12, with bowl tobacco bore 12 filled sufficiently to proceed to the next filling step of removing pipe tool 2 from bowl tobacco bore 12. The over-filling and subsequent forward tamping steps described above have been repeated until tobacco 11 is disposed within bowl tobacco bore 12 as illustrated in FIG. 6. An upper surface of tobacco 11 is disposed approximately ¼–½ inch above bowl smoke bore mouth 18. Pipe tool 2 has prevented tobacco 11 from entering bowl smoke bore mouth 18.

Pipe tool 2 is now removed from bowl tobacco bore 12. Because spade thickness 22 decreases from spade upper extreme 24 to spade lower extreme 26, pipe tool 2 is easily removed from bowl tobacco bore 12. The steps of over-filling and subsequent forward tamping steps described above are repeated until bowl tobacco bore 12 is filled to the extent illustrated in FIG. 7, that is to say, until the tobacco 11 level is slightly below the upper edge of bowl tobacco bore rear section 17. FIG. 7 is a side cross-sectional view of bowl tobacco bore 12 full of tobacco 11.

Finally, if any space remains between tobacco 11 and bowl smoke bore mouth 18, tamp down on tobacco 11 in bowl tobacco bore front section 15 (never on tobacco 11 in bowl tobacco bore rear section 17) as indicated by arrow 30, while simultaneously drawing on the pipe. Tamp until slight resistance to the draw is experienced. A finger or tamper 9 may be used during this last step. The pipe is now ready for smoking. The specific filling method steps are as follow:

Method of Filling

A. Insert pipe tool 2 into bowl tobacco bore rear section 17 so that spade 4 nests against and covers bowl smoke bore mouth 18.

B. Fill bowl tobacco bore 12 to overflowing with tobacco 11.

C. Tamp tobacco 11 in bowl tobacco bore front section 15 only downwards at a tamping angle 27 of at least 45 degrees to bowl tobacco bore vertical axis 25.

D. Repeat steps A and B until a level of tobacco 11 over bowl smoke bore mouth 18 is ¼–½ inches above bowl smoke bore mouth 18.

E. Remove pipe tool 2 from bowl tobacco bore 12.

F. Fill bowl tobacco bore 12 to overflowing with tobacco 11.

G. Tamp tobacco 11 in the front of bowl tobacco bore 12 only downwards at a tamping angle 27 of at least 45 degrees to bowl tobacco bore vertical axis 25.

H. Repeat steps F and G until a level of tobacco 11 over bowl smoke bore mouth 18 is slightly below a top edge of bowl tobacco bore 12.

I. If any space remains between tobacco 11 and bowl smoke bore mouth 18, tamp down on tobacco 11 in bowl tobacco bore front section 15 (never tobacco 11 in bowl tobacco bore rear section 17) while simultaneously drawing on the pipe. Tamp until slight resistance to the draw is experienced. A finger or tamper 9 may be used during this last step. The pipe is now ready for smoking.

FIG. 8 is a side cross-sectional view of an alternate embodiment tool, staff pipe tool 40, being used to fill bowl tobacco bore 12 in accordance with the method of filling disclosed above. Staff tool 40 comprises staff 42 terminating in staff tip 44. Staff tip 44 is sized to cover bowl smoke bore 18, thus preventing tobacco from entering bowl smoke bore 18 during the first steps of filling. The method of filling is the same as with pipe tool 2 as disclosed above, except that step A comprises inserting staff tip 44 into bowl smoke bore mouth 18, as illustrated in FIG. 8.

Method of Emptying

A. Use a pipe tool to scrape out the byproducts of combustion by scraping along a lower surface of bowl tobacco bore 12 in a direction directly away from bowl smoke bore mouth 18. This procedure helps maintain bowl smoke bore mouth 18 unclogged.

While a preferred embodiment of the invention has been illustrated herein, it is to be understood that changes and variations may be made by those skilled in the art without departing from the spirit of the appending claims.

DRAWING ITEM INDEX

2 pipe tool
4 spade
6 stem
8 handle
9 tamper
10 spade arc angle
11 tobacco
12 bowl tobacco bore
14 bowl smoke bore
15 bowl tobacco bore front section
16 stem bore
17 bowl tobacco bore rear section
18 bowl smoke bore mouth
20 handle angle
22 spade thickness
24 spade upper extreme
25 bowl tobacco bore vertical axis
26 spade lower extreme
27 tamping angle
28 tamping direction arrow
30 arrow
40 staff pipe tool
42 staff
44 staff tip

I claim:

1. A pipe tool comprising a spade rigidly attached to a handle, said spade and said handle defining a handle angle of 135 degrees±25 degrees, said spade comprising a spade upper extreme and a spade lower extreme, and an elongated channel having, an arcuate opening at said spade upper extreme, the other end of said channel being closed by a spherical section at said spade lower extreme.

2. The pipe tool of claim 1 wherein said handle angle measures 225 degrees±10 degrees.

3. The pipe tool of claim 2 wherein said handle comprises a tamper rigidly attached to a stem, said handle and said stem being co-planer, said stem being rigidly attached to said spade.

4. The pipe tool of claim 3 wherein a plan view shape of said tamper is a half-circle.

* * * * *